US010042296B2

(12) United States Patent
Miyazaki

(10) Patent No.: US 10,042,296 B2
(45) Date of Patent: Aug. 7, 2018

(54) FIXING DEVICE AND IMAGE FORMING APPARATUS

(71) Applicant: FUJI XEROX CO., LTD., Tokyo (JP)

(72) Inventor: Akio Miyazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/441,810

(22) Filed: Feb. 24, 2017

(65) Prior Publication Data

US 2018/0017906 A1 Jan. 18, 2018

(30) Foreign Application Priority Data

Jul. 14, 2016 (JP) ..... 2016-139762

(51) Int. Cl.
*G03G 15/20* (2006.01)

(52) U.S. Cl.
CPC ..... *G03G 15/2039* (2013.01)

(58) Field of Classification Search
USPC ..... 399/38, 67, 69, 107, 110, 122, 320, 328, 399/329; 219/619
See application file for complete search history.

(56) References Cited

U.S. PATENT DOCUMENTS 7,082,283 B2 * 7/2006 Fujita ..... G03G 15/2039 219/216
7,113,716 B2 * 9/2006 Tomatsu ..... G03G 15/2064 399/329
8,886,090 B2 * 11/2014 Kawata ..... G03G 15/205 399/122
9,188,916 B2 * 11/2015 Murakami ..... G03G 15/2039

FOREIGN PATENT DOCUMENTS

JP 2003-015071 A 1/2003
JP 2003-075760 A 3/2003

* cited by examiner

*Primary Examiner* — Hoan Tran
(74) *Attorney, Agent, or Firm* — Sughrue Mion, PLLC

(57) ABSTRACT

A fixing device includes a heating member that heats a recording medium having an image while transporting the recording medium by rotating; a measuring member that measures a temperature of the heating member and includes a body member, and a cantilever member whose base end is fixed to the body member and whose free end is in contact with the heating member; and a supporting member that supports the measuring member and includes a contact portion, the contact portion being in contact with a base portion of the cantilever member.

19 Claims, 4 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2016-139762 filed Jul. 14, 2016.

BACKGROUND

Technical Field

The present invention relates to a fixing device and an image forming apparatus.

SUMMARY

According to an aspect of the invention, there is provided a fixing device including a heating member that heats a recording medium having an image while transporting the recording medium by rotating; a measuring member that measures a temperature of the heating member and includes a body member, and a cantilever member whose base end is fixed to the body member and whose free end is in contact with the heating member; and a supporting member that supports the measuring member and includes a contact portion, the contact portion being in contact with a base portion of the cantilever member.

BRIEF DESCRIPTION OF THE DRAWINGS

An exemplary embodiment of the present invention will be described in detail based on the following figures, wherein.

DETAILED DESCRIPTION

An image forming apparatus according to an exemplary embodiment of the present invention will now be described with reference to FIGS. 1 to 4, in which arrow H represents the apparatus-top-bottom direction (the vertical direction), arrow W represents the apparatus-width direction (a horizontal direction), and arrow D represents the apparatus-depth direction (another horizontal direction).

Overall Configuration

Figure 4:
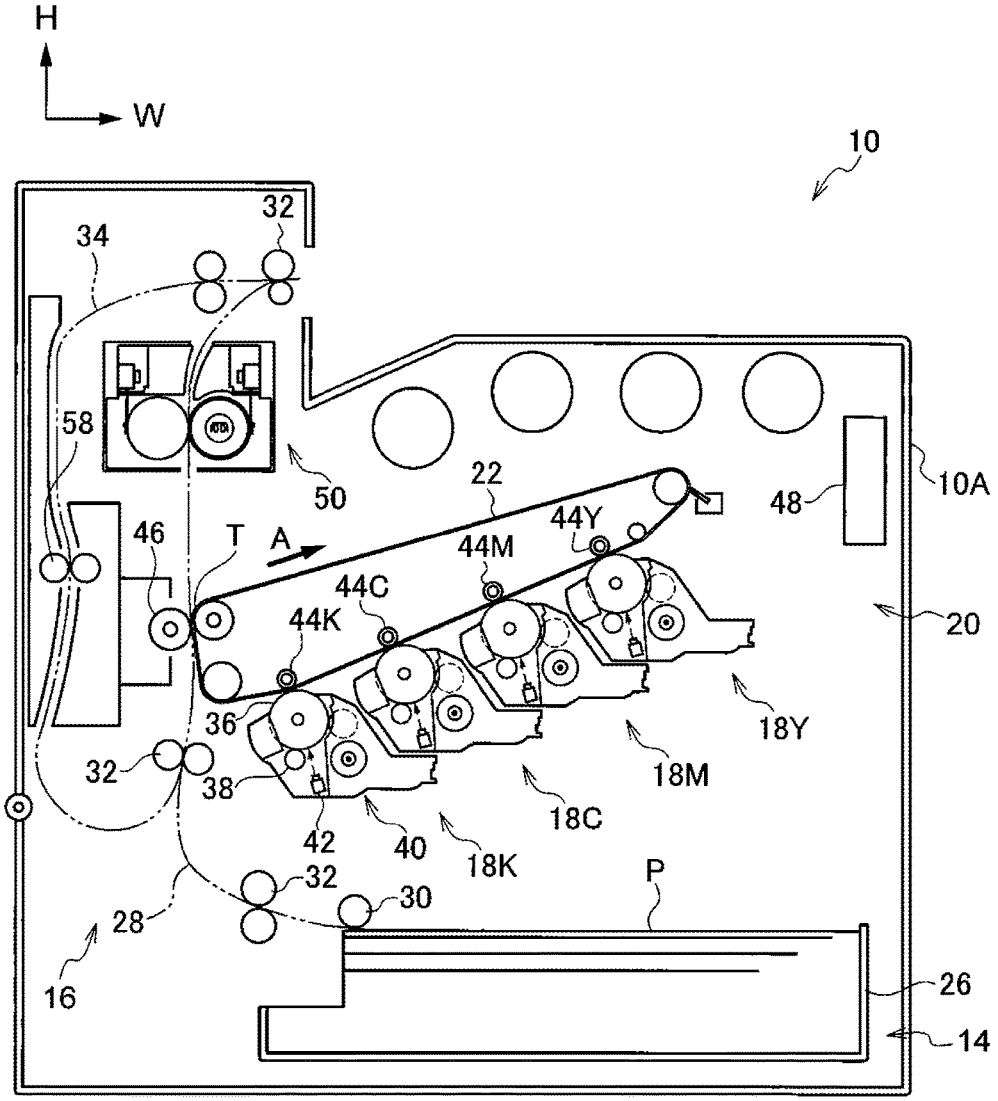
FIG. 4 is a schematic diagram of the image forming apparatus according to the exemplary embodiment of the present invention.

Referring to FIG. 4, an image forming apparatus 10 according to the exemplary embodiment includes, in order from the bottom to the top thereof (in the direction of arrow H), a container 14 that contains sheet members P as recording media, a transporting section 16 that transports each of the sheet members P contained in the container 14, and an image forming section 20 that forms an image on the sheet member P transported thereto from the container 14 by the transporting section 16. The image forming apparatus 10 further includes a controller 48 that controls the above elements.

Container

The container 14 includes a container member 26 that is drawable from an apparatus body 10A of the image forming apparatus 10 toward the near side in the apparatus-depth direction. The sheet members P are stacked in the container member 26. The container member 26 is provided with a pickup roller 30 that picks up one of the sheet members P stacked in the container member 26 and feeds the sheet member P into a transport path 28 running through the transporting section 16.

Transporting Section

The transporting section 16 is provided with plural pairs of transporting rollers 32 that transport the sheet member P received from the container 14 along the transport path 28.

The transporting section 16 further includes a reverse transport path 34 along which the sheet member P having an image on the front side thereof is transported if another image is to be formed on the back side of the sheet member P. The reverse transport path 34 is provided with a pair of transporting rollers 58 that transports the sheet member P along the reverse transport path 34.

Image Forming Section

The image forming section 20 includes four image forming units 18Y, 18M, 18C, and 18K provided for yellow (Y), magenta (M), cyan (C), and black (K), respectively. Hereinafter, the suffixes Y, M, C, and K may be omitted if there is no need to distinguish the four units 18Y, 18M, 18C, and 18K from one another by their colors. The image forming units 18 are each attachable to and detachable from the apparatus body 10A.

Each of the image forming units 18 includes an image carrier 36, a charging member 38 that charges the surface of the image carrier 36, an exposure device 42 that applies exposure light to the charged image carrier 36 and thus forms an electrostatic latent image on the image carrier 36, and a developing device 40 that develops and visualizes the electrostatic latent image into a toner image.

The image forming section 20 further includes an endless transfer belt 22 that rotates in a direction of arrow A illustrated in FIG. 4, first transfer rollers 44 that transfer the respective toner images formed by the respective image forming units 18 to the transfer belt 22, a second transfer roller 46 that transfers the toner images on the transfer belt 22 to the sheet member P, and a fixing device 50 that heats and presses the sheet member P having the toner images and thus fixes the toner images on the sheet member P.

The fixing device 50 will be described in detail later.

Operation of Image Forming Apparatus

The image forming apparatus 10 forms an image as follows.

First, in each of the image forming units 18, the charging member 38 to which a voltage is applied charges the surface of the image carrier 36 uniformly with a predetermined negative potential. Subsequently, the exposure device 42 applies exposure light to the charged surface of the image carrier 36 on the basis of image data received from an external device.

Thus, an electrostatic latent image based on the image data is formed on the surface of the image carrier 36. Then, the developing device 40 develops and visualizes the electrostatic latent image into a toner image. Toner images thus formed on the surfaces of the four image carriers 36 are transferred to the transfer belt 22 by the respective first transfer rollers 44.

Meanwhile, a sheet member P is fed from the container member 26 into the transport path 28 by the pickup roller 30 and is transported to a transfer position T where the transfer belt 22 is in contact with the second transfer roller 46. At the transfer position T, the sheet member P passes through the nip between the transfer belt 22 and the second transfer roller 46, whereby the toner images on the transfer belt 22 are transferred to the front of the sheet member P.

The toner images thus transferred to the front side of the sheet member P are fixed on the sheet member P by the fixing device 50, whereby a finished image is obtained. Then, the sheet member P having the finished image is discharged to the outside of the apparatus body 10A.

If another image is to be formed on the back side of the sheet member P, the sheet member P having the finished image on the front side thereof is fed into the reverse transport path 34, where the sheet member P is turned upside down, and is further fed into the transport path 28. A process of forming another image on the back side of the sheet member P is the same as the above process of forming an image on the front side of the sheet member P.

Configuration of Featured Element

The configuration of the fixing device 50 will now be described.

Figure 1:
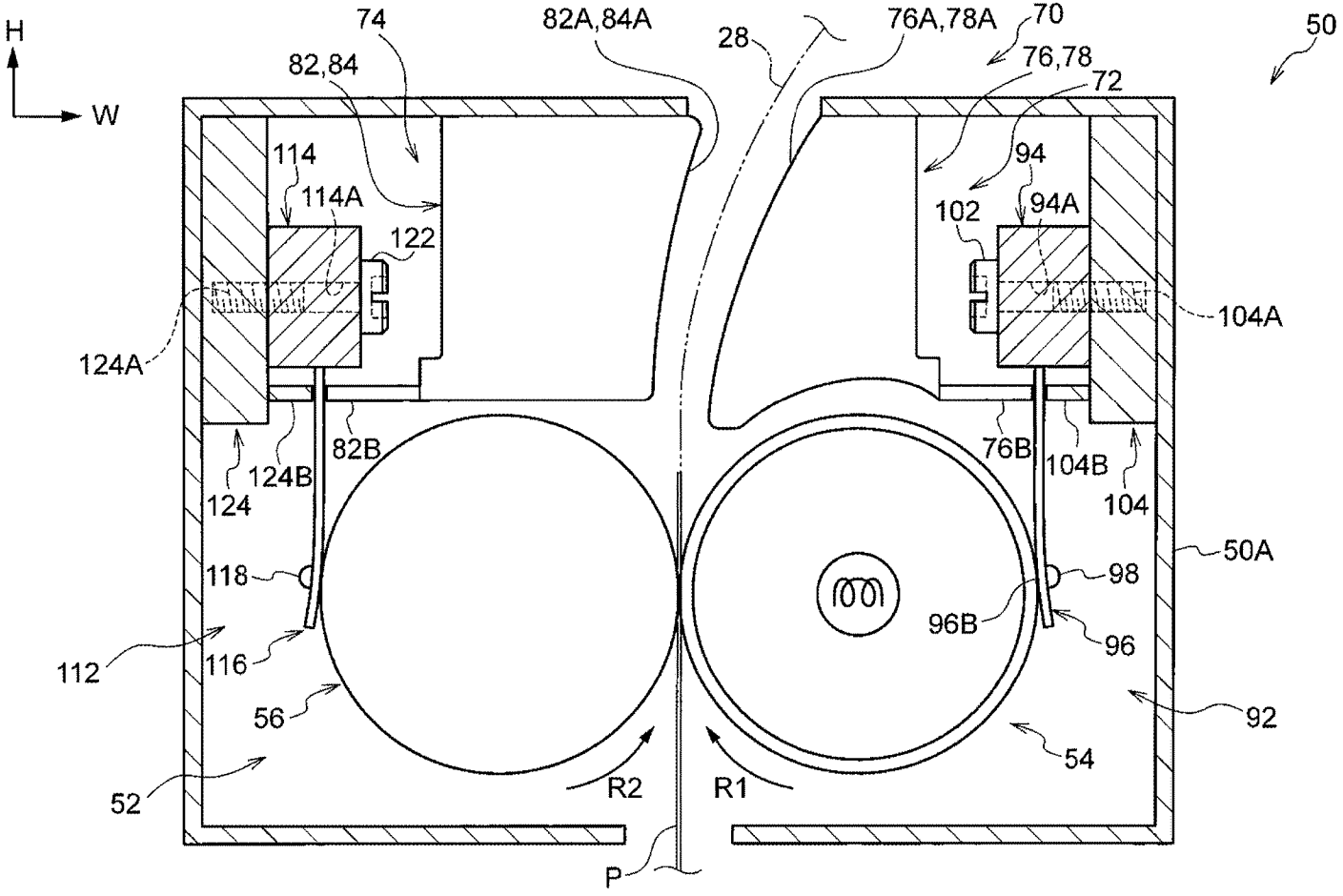
FIG. 1 is a front view of a fixing device included in an image forming apparatus according to the exemplary embodiment of the present invention.

Referring to FIG. 1, the fixing device 50 includes a housing 50A that houses the following elements: a fixing member 52 that fixes the toner images on the sheet member P, and a guiding portion 70 that guides the sheet member P transported through the fixing device 50.

The fixing device 50 further includes a first measuring member 92, and a first supporting member 104 that supports the first measuring member 92. The first measuring member 92 measures the temperature of a heating roller 54, which is an exemplary heating member included in the fixing member 52. The first measuring member 92 is an exemplary measuring member. The first supporting member 104 is an exemplary supporting member.

The fixing device 50 further includes a second measuring member 112, and a second supporting member 124 that supports the second measuring member 112. The second measuring member 112 measures the temperature of a pressing roller 56, which is an exemplary pressing member included in the fixing member 52. The second measuring member 112 is another exemplary measuring member. The second supporting member 124 is another exemplary supporting member.

Fixing Member

The heating roller 54 included in the fixing member 52 is provided thereinside with a heat source and has a columnar shape. The heating roller 54 rotates in a direction of arrow R1 illustrated in FIG. 1 when a rotational force is transmitted thereto from a driving member (not illustrated). The fixing member 52 further includes the pressing roller 56 positioned across the transport path 28 from the heating roller 54. The pressing roller 56 has a columnar shape and rotates in a direction of arrow R2 illustrated in FIG. 1 by following the rotation of the heating roller 54. The pressing roller 56 presses the sheet member P against the heating roller 54.

In such a configuration, the sheet member P having the toner images transferred thereto is transported through the nip between the heating roller 54 that is rotating and the pressing roller 56. Thus, the fixing member 52 fixes the toner images on the sheet member P.

Guiding Portion

The guiding portion 70 is positioned on the downstream side with respect to the fixing member 52 in the direction of transport of the sheet member P (hereinafter referred to as "the sheet-transporting direction"). The guiding portion 70 includes a first guiding portion 72 provided on the side of the heating roller 54, and a second guiding portion 74 provided across the transport path 28 from the first guiding portion 72.

First Guiding Portion

Figure 2:
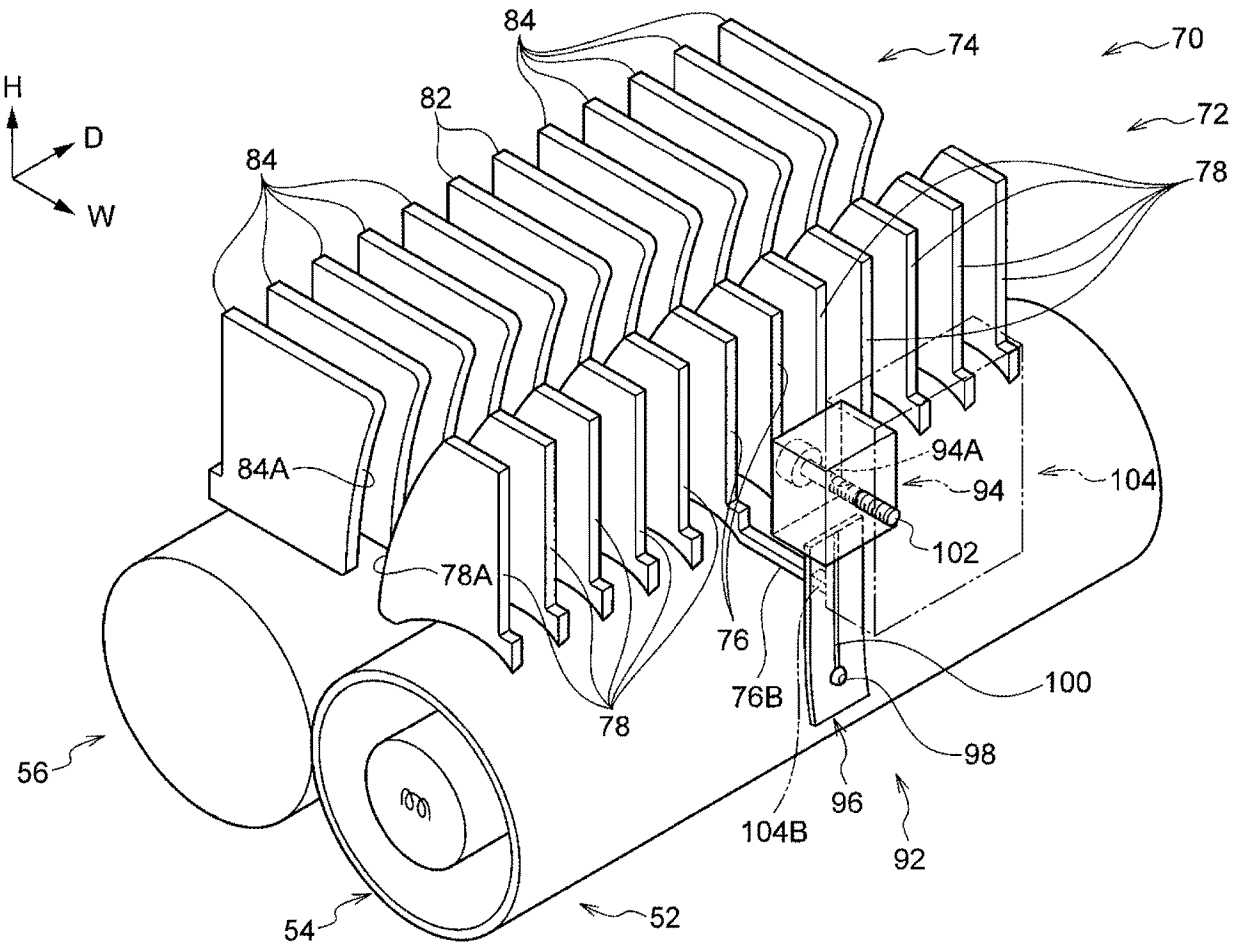
FIG. 2 is a perspective view of the fixing device included in the image forming apparatus according to the exemplary embodiment of the present invention.

Referring to FIG. 2, the first guiding portion 72 includes a pair of guiding plates 76 and plural guiding plates 78 that are arranged at intervals in the apparatus-depth direction, with the major surfaces thereof each facing either side in the apparatus-depth direction.

The pair of guiding plates 76, which are made of a resin material, are positioned near a central part, in the apparatus-depth direction, of the heating roller 54 and face each other in the apparatus-depth direction. The plural guiding plates 78, which are also made of a resin material, are provided on two outer sides of the pair of guiding plates 76 in the apparatus-depth direction. The guiding plates 76 are exemplary guiding members.

Referring to FIG. 1, the guiding plates 76 and 78 each have a guiding edge 76A or 78A on a side thereof facing the transport path 28. The guiding edges 76A and 78A each have a curved shape and guide the sheet member P toward the downstream side in the sheet-transporting direction.

The guiding plates 76 each include a contact portion 76B on a side thereof opposite the guiding edge 76A in the apparatus-width direction. The contact portion 76B extends in a direction away from the transport path 28 and is in contact with a base portion of a cantilever member 96, which will be described later. The guiding plates 76 differ from the guiding plates 78 in including the contact portions 76B.

Second Guiding Portion

Figure 3:
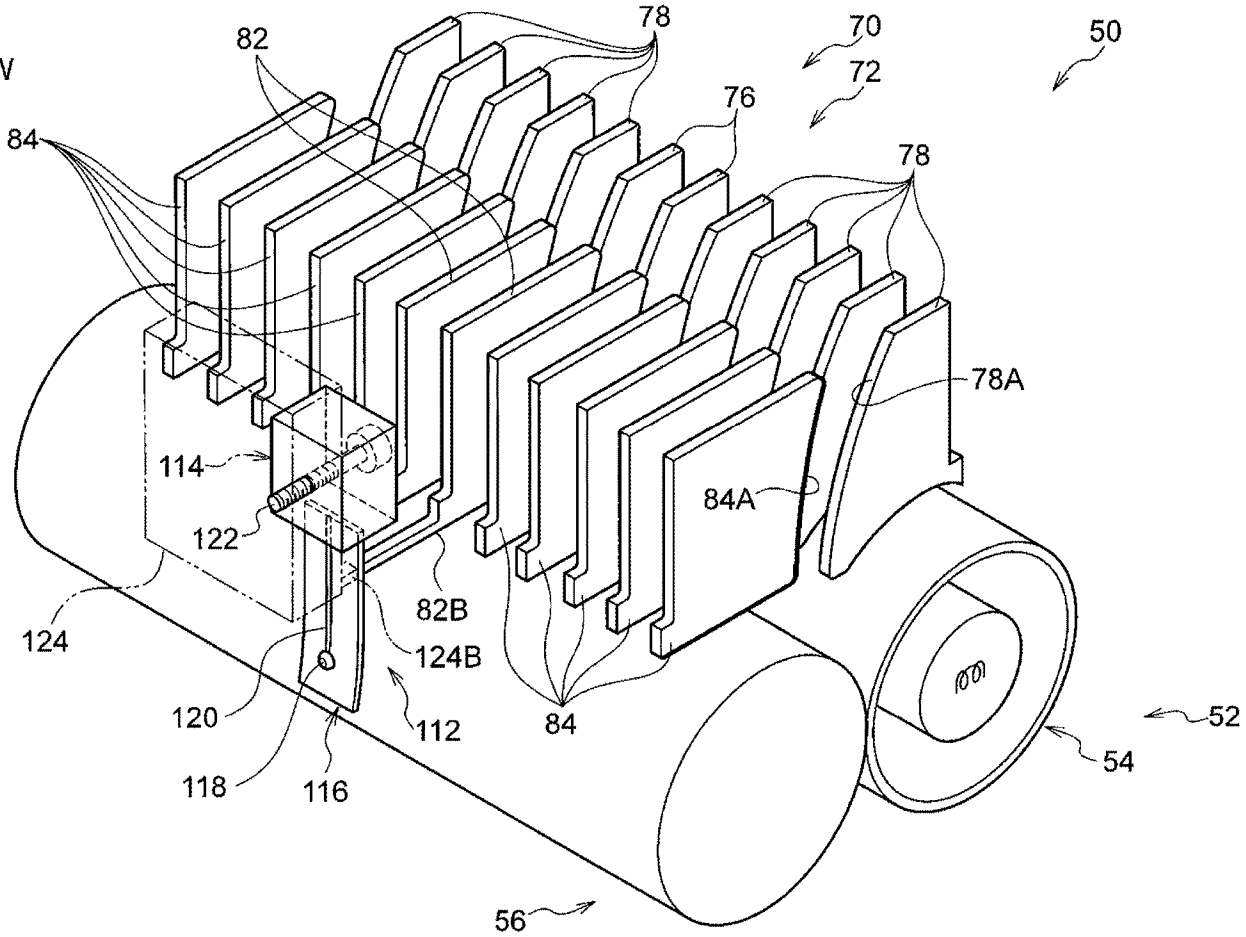
FIG. 3 is another perspective view of the fixing device included in the image forming apparatus according to the exemplary embodiment of the present invention.

Referring to FIG. 3, the second guiding portion 74 includes a pair of guiding plates 82 and plural guiding plates 84 that are arranged at intervals in the apparatus-depth direction, with the major surfaces thereof each facing either side in the apparatus-depth direction.

The pair of guiding plates 82 are positioned near a central part, in the apparatus-width direction, of the pressing roller 56 and face each other in the apparatus-depth direction. The plural guiding plates 84 are provided on two outer sides of the pair of guiding plates 82 in the apparatus-depth direction.

Referring to FIG. 1, the guiding plates 82 and 84 each have a guiding edge 82A or 84A on a side thereof facing the transport path 28. The guiding edges 82A and 84A each have a curved shape and guide the sheet member P toward the downstream side in the sheet-transporting direction while receiving the sheet member P that comes into contact therewith. The guiding plates 82 each include a contact portion 82B on a side thereof opposite the guiding edge 82A in the apparatus-width direction. The contact portion 82B extends in a direction away from the transport path 28 and is in contact with a base portion of a cantilever member 116, which will be described later.

The guiding plates 82 differ from the guiding plates 84 in including the contact portions 82B.

First Measuring Member and First Supporting Member

Referring to FIG. 1, when seen in the apparatus-depth direction, the first measuring member 92 and the first supporting member 104 are provided across the first guiding portion 72 from the transport path 28. Referring to FIG. 2, the first measuring member 92 and the first supporting member 104 are positioned near the central part, in the apparatus-depth direction, of the heating roller 54.

The first measuring member 92 is a thermistor and includes a body member 94 and the cantilever member 96 whose base end is fixed to the body member 94. The cantilever member 96 extends downward from the body member 94. As illustrated in FIG. 1, the body member 94 has a rectangular-parallelepiped shape and has a through hole 94A extending therethrough in the apparatus-width direction. The body member 94 is an exemplary body member. The cantilever member 96 is an exemplary cantilever member.

The cantilever member 96 is made of plate metal. The free end of the cantilever member 96 is in contact on the front side thereof with the surface of the heating roller 54, whereby the cantilever member 96 is bent. The cantilever member 96 is provided at the free end thereof and on the back side thereof with an element 98 and a wiring line 100 (see FIG. 2) that are fixed thereto. The element 98 has a resistance that varies with temperature. A voltage is applied to the element 98 through the wiring line 100. The tips of the contact portions 76B of the guiding plates 76 are in contact with the front side of the base portion of the cantilever member 96.

The first supporting member 104 is formed of resin. When seen in the apparatus-depth direction, the first supporting member 104 is provided across the body member 94 from the guiding plates 76 and is fixed to the housing 50A. The first supporting member 104 includes a pair of contact portions 104B extending toward the cantilever member 96 and being in contact with the back side of the base portion of the cantilever member 96. Thus, the cantilever member 96 is held between the pair of contact portions 104B of the first supporting member 104 and the contact portions 76B of the pair of guiding plates 76.

As illustrated in FIG. 1, the first supporting member 104 has a screw hole 104A. A screw 102 is inserted into the through hole 94A of the body member 94 and is screwed into the screw hole 104A, whereby the first measuring member 92 is supported by the first supporting member 104.

In such a configuration, the first measuring member 92 measures the temperature of the heating roller 54 by detecting the resistance value of the element 98.

Second Measuring Member and Second Supporting Member

Referring to FIG. 1, when seen in the apparatus-depth direction, the second measuring member 112 and the second supporting member 124 are provided across the second guiding portion 74 and the pressing roller 56 from the transport path 28. Referring to FIG. 3, the second measuring member 112 and the second supporting member 124 are provided near the central part, in the apparatus-depth direction, of the pressing roller 56.

The second measuring member 112 is a thermistor and includes a body member 114 and the cantilever member 116 whose base end is fixed to the body member 114. The cantilever member 116 extends downward from the body member 114. As illustrated in FIG. 1, the body member 114 has a rectangular-parallelepiped shape and has a through hole 114A extending therethrough in the apparatus-width direction. The body member 114 is another exemplary body member. The cantilever member 116 is another exemplary cantilever member.

The cantilever member 116 is made of plate metal. The free end of the cantilever member 116 is in contact on the front side thereof with the surface of the pressing roller 56, whereby the cantilever member 116 is bent. The cantilever member 116 is provided at the free end thereof and on the back side thereof with an element 118 and a wiring line 120 (see FIG. 3) that are fixed thereto. The element 118 has a resistance that varies with temperature. A voltage is applied to the element 118 through the wiring line 120. The tips of the contact portions 82B of the guiding plates 82 are in contact with the front side of the base portion of the cantilever member 116.

The second supporting member 124 is formed of resin. When seen in the apparatus-depth direction, the second supporting member 124 is provided across the body member 114 from the guiding plates 82 and is fixed to the housing 50A. The second supporting member 124 includes a pair of contact portions 124B extending toward the cantilever member 116 and being in contact with the back side of the baes portion of the cantilever member 116. Thus, the cantilever member 116 is held between the pair of contact portions 124B of the second supporting member 124 and the contact portions 82B of the pair of guiding plates 82.

The second supporting member 124 has a screw hole 124A. A screw 122 is inserted into the through hole 114A of the body member 114 and is screwed into the screw hole 124A, whereby the second measuring member 112 is supported by the second supporting member 124.

In such a configuration, the second measuring member 112 measures the temperature of the pressing roller 56 by detecting the resistance value of the element 118.

Functions

An overall function of the fixing device 50, a function of the first measuring member 92 of the fixing device 50, and a function of the second measuring member 112 of the fixing device 50 will now be described.

Overall Function

Referring to FIG. 1, the heating roller 54 that rotates in the direction of arrow R1 transports a sheet member P having a toner image while nipping the sheet member P in cooperation with the pressing roller 56. Thus, the fixing member 52 fixes the toner images on the sheet member P.

The guiding plates 76 and 78 and the guiding plates 82 and 84 guide the sheet member P, transported by the heating roller 54 and the pressing roller 56, toward the downstream side in the sheet-transporting direction.

First Measuring Member

The first measuring member 92 measures the temperature at the surface of the heating roller 54 that is rotating. Specifically, the front side of the free end of the cantilever member 96 having the element 98 at the back thereof is brought into contact with the surface of the heating roller 54, whereby the heat of the heating roller 54 is transferred to the element 98 through the cantilever member 96. Consequently, the resistance value of the element 98 changes. Thus, the first measuring member 92 measures the temperature of the heating roller 54. In such a configuration, a so-called stick-slip phenomenon may occur between the heating roller 54 that is rotating and the cantilever member 96. In the stick-slip phenomenon, a combination of a frictional force generated between the surface of the heating roller 54 and the surface of the cantilever member 96 and a rotational force of the heating roller 54 repeatedly causes sticking and slipping between the surface of the heating roller 54 and the surface of the cantilever member 96.

In a known case where the contact portions 76B and the contact portions 104B that are in contact with the base portion of the cantilever member 96 are not provided, the stick-slip phenomenon causes the cantilever member 96 to vibrate in the direction of the thickness of the cantilever member 96.

According to the present exemplary embodiment, the guiding plates 76, which are known components, include the respective contact portions 76B that are in contact with the base portion of the cantilever member 96, and the first supporting member 104, which is also a known component, includes the contact portions 104B that are in contact with the base portion of the cantilever member 96.

Moreover, the cantilever member 96 is held between the contact portions 76B and the contact portions 104B.

Furthermore, the guiding plates 76 including the contact portions 76B are made of a resin material having a lower coefficient of heat transfer than metal materials.

Furthermore, the first supporting member 104 including the contact portions 104B is made of a resin material having a lower coefficient of heat transfer than metal materials.

Second Measuring Member

The second measuring member 112 measures the temperature at the surface of the pressing roller 56 that is rotating. Specifically, the front side of the free end of the cantilever member 116 having the element 118 at the back thereof is brought into contact with the surface of the pressing roller 56, whereby the heat of the pressing roller 56 is transferred to the element 118 through the cantilever member 116. Consequently, the resistance value of the element 118 changes. Thus, the second measuring member 112 measures the temperature of the pressing roller 56. In such a configuration, a so-called stick-slip phenomenon may occur between the pressing roller 56 that is rotating and the cantilever member 116.

In a known case where the contact portions 82B and the contact portions 124B that are in contact with the base portion of the cantilever member 116 are not provided, the stick-slip phenomenon causes the cantilever member 116 to vibrate in the direction of the thickness of the cantilever member 116.

According to the present exemplary embodiment, the guiding plates 82, which are known components, include the respective contact portions 82B that are in contact with the base portion of the cantilever member 116, and the second supporting member 124, which is also a known component, includes the contact portions 124B that are in contact with the base portion of the cantilever member 116.

Moreover, the cantilever member 116 is held between the contact portions 82B and the contact portions 124B.

Furthermore, the guiding plates 82 including the contact portions 82B are made of a resin material having a lower coefficient of heat transfer than metal materials.

Furthermore, the second supporting member 124 including the contact portions 124B is made of a resin material having a lower coefficient of heat transfer than metal materials.

While a specific exemplary embodiment of the present invention has been described in detail above, the present invention is not limited to the above exemplary embodiment. It is obvious for those skilled in the art that various other embodiments are conceivable within the scope of the present invention. For example, while the above exemplary embodiment concerns a case where both the contact portions 76B and the contact portions 104B are in contact with the base portion of the cantilever member 96, at least one of the contact portions 76B and the contact portions 104B only need to be in contact with the base portion of the cantilever member 96. In that case, however, only the effect produced by the contact portions 76B or 104B that are in contact with the cantilever member 96 is exerted.

While the above exemplary embodiment concerns a case where both the contact portions 82B and the contact portions 124B are in contact with the base portion of the cantilever member 116, at least one of the contact portions 82B and the contact portions 124B only need to be in contact with the base portion of the cantilever member 116. In that case, however, only the effect produced by the contact portions 82B or 124B that are in contact with the cantilever member 116 is exerted.

Although not specifically described in the above exemplary embodiment, since the above exemplary embodiment employs the contact portions 76B and the contact portions 104B that are in contact with the base portion of the cantilever member 96, the natural frequency of the cantilever member 96 is changed.

Although not specifically described in the above exemplary embodiment, since the above exemplary embodiment employs the contact portions 82B and the contact portions 124B that are in contact with the base portion of the cantilever member 116, the natural frequency of the cantilever member 116 is changed.

While the heating roller 54 according to the above exemplary embodiment is a columnar member, the heating roller 54 may be a belt-type member.

While the pressing roller 56 according to the above exemplary embodiment is a columnar member, the pressing roller 56 may be a belt-type member.

While the first measuring member 92 according to the above exemplary embodiment is provided near the central part, in the apparatus-depth direction, of the heating roller 54, the first measuring member 92 may be provided at an end, in the apparatus-depth direction, of the heating roller 54.

While the second measuring member 112 according to the above exemplary embodiment is provided near the central part, in the apparatus-depth direction, of the pressing roller 56, the second measuring member 112 may be provided at an end, in the apparatus-depth direction, of the pressing roller 56.

While the above exemplary embodiment employs the fixing device 50 including the guiding portion 70 that guides the sheet member P to be transported, the guiding portion 70 may be included in another device.

While the above exemplary embodiment employs the second measuring member 112 that measures the temperature of the pressing roller 56, the second measuring member 112 may be omitted if there is no need to measure the temperature of the pressing roller 56.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating member configured to heat a recording medium having an image while transporting the recording medium by rotating;

a measuring member configured to measure a temperature of the heating member, wherein the measuring member includes:

a body member; and a cantilever member whose base end is fixed to the body member and whose free end is in contact with the heating member; and a supporting member that supports the measuring member, wherein the supporting member includes a contact portion, the contact portion being in contact with a base portion of the cantilever member, wherein the contact portion is separated from the body member.

2. The fixing device according to claim 1, wherein the supporting member is formed of resin.

3. The fixing device according to claim 2, further comprising:

a pressing member configured to press the recording medium having the image against the heating member while rotating;

another measuring member configured to measure a temperature of the pressing member, the another measuring member including:

another body member; and another cantilever member whose base end is fixed to the body member and whose free end is in contact with the pressing member; and another supporting member that supports the another measuring member, wherein the another supporting member includes another contact portion that is in contact with a base portion of the another cantilever member.

4. An image forming apparatus comprising:

a forming unit configured to form a toner image;

a transfer unit configured to transfer the toner image formed by the forming unit to a recording medium; and the fixing device according to claim 2 configured to fix the toner image transferred to the recording medium by the transfer unit on the recording medium.

5. The fixing device according to claim 1, further comprising:

a pressing member configured to press the recording medium having the image against the heating member while rotating;

another measuring member configured to measure a temperature of the pressing member, the another measuring member including:

another body member; and another cantilever member whose base end is fixed to the body member and whose free end is in contact with the pressing member; and another supporting member that supports the another measuring member, wherein the another supporting member includes another contact portion that is in contact with a base portion of the another cantilever member.

6. An image forming apparatus comprising:

a forming unit configured to form a toner image;

a transfer unit configured to transfer the toner image formed by the forming unit to a recording medium; and the fixing device according to claim 5 configured to fix the toner image transferred to the recording medium by the transfer unit on the recording medium.

7. An image forming apparatus comprising:

a forming unit configured to form a toner image;

a transfer unit configured to transfer the toner image formed by the forming unit to a recording medium; and the fixing device according to claim 1 configured to fix the toner image transferred to the recording medium by the transfer unit on the recording medium.

8. The fixing device according to claim 1, wherein the fixing device is configured with a gap between the body member and the contact portion.

9. The fixing device according to claim 1, wherein the cantilever member extends from the base end to the free end in a first direction, and wherein the contact portion overlaps with the body member in the first direction.

10. The fixing device according to claim 1, wherein the contact portion extends from the supporting member to a base portion of the cantilever member.

11. A fixing device comprising:

a heating member configured to heat a recording medium having an image while transporting the recording medium by rotating;

a measuring member configured to measure a temperature of the heating member, wherein the measuring member includes:

a body member; and a cantilever member whose base end is fixed to the body member and whose free end is in contact with the heating member;

a supporting member that supports the measuring member; and a guiding member configured to guide the recording medium while being in contact with the recording medium that is transported by the heating member, wherein at least one of the supporting member and the guiding member includes a contact portion that is in contact with a base portion of the cantilever member, wherein the contact portion is included in the guiding member, and wherein the guiding member is made of a resin material.

12. The fixing device according to claim 11, wherein the supporting member is formed of resin.

13. The fixing device according to claim 11, further comprising:

a pressing member configured to press the recording medium having the image against the heating member while rotating;

another measuring member configured to measure a temperature of the pressing member, the another measuring member including:

another body member; and another cantilever member whose base end is fixed to the body member and whose free end is in contact with the pressing member; and another supporting member that supports the another measuring member, wherein the another supporting member includes another contact portion that is in contact with a base portion of the another cantilever member.

14. An image forming apparatus comprising:

a forming unit configured to form a toner image;

a transfer unit configured to transfer the toner image formed by the forming unit to a recording medium; and the fixing device according to claim 11 configured to fix the toner image transferred to the recording medium by the transfer unit on the recording medium.

15. A fixing device comprising:

a heating member configured to heat a recording medium having an image while transporting the recording medium by rotating;

a measuring member configured to measure a temperature of the heating member, wherein the measuring member includes:

a body member; and a cantilever member whose base end is fixed to the body member and whose free end is in contact with the heating member;

a supporting member that supports the measuring member, wherein the supporting member includes a first contact portion that is in contact with a base portion of the cantilever member; and a guiding member configured to guide the recording medium while being in contact with the recording medium that is transported by the heating member, the guiding member including a second contact portion that is in contact with the base portion of the cantilever member, wherein the cantilever member is held between the first contact portion and the second contact portion.

16. The fixing device according to claim 15, wherein the contact portion is included in the guiding member, and wherein the guiding member is made of a resin material.

17. The fixing device according to claim 15, wherein the supporting member is formed of resin.

18. The fixing device according to claim 15, further comprising:

a pressing member configured to press the recording medium having the image against the heating member while rotating;

another measuring member configured to measure a temperature of the pressing member, the another measuring member including:

another body member; and another cantilever member whose base end is fixed to the body member and whose free end is in contact with the pressing member; and another supporting member that supports the another measuring member, wherein the another supporting member includes another contact portion that is in contact with a base portion of the another cantilever member.

19. An image forming apparatus comprising:

a forming unit configured to form a toner image;

a transfer unit configured to transfer the toner image formed by the forming unit to a recording medium; and the fixing device according to claim 15 configured to fix the toner image transferred to the recording medium by the transfer unit on the recording medium.

* * * * *